US011800937B2

(12) United States Patent
Spinks et al.

(10) Patent No.: US 11,800,937 B2
(45) Date of Patent: Oct. 31, 2023

(54) RESILIENT UNIT WITH DIFFERENT MAJOR SURFACES

(71) Applicant: Harrison Spinks Components Limited, Leeds (GB)

(72) Inventors: Simon Paul Spinks, Cawood (GB); David Clare, Barnsley (GB)

(73) Assignee: Harrison Spinks Components Limited, Leeds (GB)

( * ) Notice: Subject to any disclaimer, the term of this patent is extended or adjusted under 35 U.S.C. 154(b) by 0 days.

(21) Appl. No.: 14/420,690

(22) PCT Filed: Aug. 8, 2013

(86) PCT No.: PCT/GB2013/052131

§ 371 (c)(1),
(2) Date: Feb. 10, 2015

(87) PCT Pub. No.: WO2014/023975

PCT Pub. Date: Feb. 13, 2014

(65) Prior Publication Data

US 2015/0230621 A1 Aug. 20, 2015

(30) Foreign Application Priority Data

Aug. 10, 2012 (GB) ..... 1214312

(51) Int. Cl.
*A47C 27/07* (2006.01)
*A47C 27/06* (2006.01)
(Continued)

(52) U.S. Cl.
CPC ..... *A47C 27/064* (2013.01); *A47C 31/00* (2013.01); *A47C 31/001* (2013.01);
(Continued)

(58) Field of Classification Search
CPC ..... A47C 23/002; A47C 27/07; A47C 27/065; A47C 27/064; A47C 27/0456;
(Continued)

(56) References Cited

U.S. PATENT DOCUMENTS 274,715 A 3/1883 Buckley
380,651 A * 4/1888 Fowler ..... F16F 1/08 267/166.1

(Continued)

FOREIGN PATENT DOCUMENTS

CA 2225304 A1 6/1998
CN 2903019 Y 5/2007

(Continued)

OTHER PUBLICATIONS

Search Report issued by British Intellectual Property Office in related British Patent App. No. 1214312.9 dated Nov. 6, 2012 (6 pages).

(Continued)

*Primary Examiner* — Robert G Santos
*Assistant Examiner* — Ifeolu A Adeboyejo
(74) *Attorney, Agent, or Firm* — Gesmer Updegrove LLP

(57) ABSTRACT

A resilient unit comprises a number of wire coil springs 12, each of which is located within its own discrete pocket 14 formed by first, upper and second, lower layers 14*a* and 14*b* of material, preferably of non-woven material. The two layers 14*a* and 14*b* have been thermally, or ultrasonically, welded together at points 16 between the adjacent springs to create the pockets. The upper layer of material 14*a* differs from the lower layer of material 14*b* in respect of at least one characteristic.

31 Claims, 1 Drawing Sheet

(51) Int. Cl.
*B68G 9/00* (2006.01)
*A47C 31/00* (2006.01)

(52) U.S. Cl.
CPC ..... *A47C 31/004* (2013.01); *A47C 31/005* (2013.01); *A47C 31/007* (2013.01); *B68G 9/00* (2013.01); *Y10T 29/481* (2015.01)

(58) Field of Classification Search
CPC ... A47C 31/007; A47C 31/005; A47C 31/004; A47C 31/001; A47C 31/00
USPC ..... 5/483, 484, 698, 954, 44, 699, 939
See application file for complete search history.

(56) References Cited

U.S. PATENT DOCUMENTS 653,155 A 7/1900 Tilden
1,480,796 A 1/1924 Van Orman
1,531,547 A * 3/1925 Edelson ..... A47C 27/07 5/719
1,561,468 A 11/1925 Jordan et al.
1,852,943 A 4/1932 Swanson
1,896,670 A 2/1933 Garst
1,915,264 A 6/1933 Schneider et al.
1,963,053 A 6/1934 Powers
1,963,054 A 6/1934 Powers
2,114,008 A 4/1938 Wunderlich
2,250,042 A 7/1941 Sundt et al.
2,276,002 A 3/1942 Torok
2,388,106 A 10/1945 Woller
2,461,062 A * 2/1949 Kane ..... A47C 27/063 5/720
2,716,308 A 8/1955 Hodges, Jr.
3,073,565 A 1/1963 Daumy
3,319,447 A 5/1967 Wise
3,355,747 A 12/1967 Norman
3,462,779 A * 8/1969 Thompson ..... A47C 27/063 297/452.53
3,990,587 A 11/1976 Redman
4,018,956 A * 4/1977 Casey ..... D04H 11/00 427/197
4,077,619 A 3/1978 Borlinghaus
4,109,443 A 8/1978 Findlay
4,111,407 A * 9/1978 Stager ..... F16F 1/08 267/166
4,160,544 A 7/1979 Higgins
4,365,767 A 12/1982 Benthimere
4,397,453 A 8/1983 Seecamp
4,439,977 A 4/1984 Stumpf
4,485,506 A * 12/1984 Stumpf ..... A47C 27/064 267/83
4,529,848 A 7/1985 Cherry
4,549,323 A * 10/1985 Brockhaus ..... A47C 21/048 428/178
4,711,067 A 12/1987 Magni
4,733,036 A 3/1988 Koizumi et al.
4,809,375 A 3/1989 Bull
4,881,393 A 11/1989 Sykes
4,961,982 A * 10/1990 Taylor ..... A61F 5/485 112/475.08
4,986,634 A 1/1991 Horikawa et al.
5,023,970 A * 6/1991 Tesch ..... A47G 9/0207 5/482
5,040,255 A 8/1991 Barber, Jr.
5,127,635 A 7/1992 Long et al.
5,311,624 A * 5/1994 Hutchinson ..... A47C 27/003 428/68
5,425,531 A 6/1995 Perrault
5,438,718 A * 8/1995 Kelly ..... A47C 27/001 29/91.1
5,467,489 A 11/1995 Cchen
5,501,317 A 3/1996 Sommer et al.
5,503,375 A 4/1996 Balsells
5,488,746 A 12/1996 Hudson
5,586,511 A 12/1996 Porter et al.
5,669,093 A 9/1997 Ogle et al.
5,791,638 A 8/1998 Balsells
5,878,998 A 3/1999 Hsieh
5,885,407 A 3/1999 Mossbeck
5,957,438 A 9/1999 Workman et al.
5,966,759 A 10/1999 Sanders et al.
5,987,668 A * 11/1999 Ackley ..... A47C 27/22 428/159
6,036,181 A 3/2000 Workman
6,049,959 A 4/2000 Grondahl
6,085,397 A 7/2000 Workman et al.
6,131,892 A 10/2000 Stumpf
6,159,319 A * 12/2000 Mossbeck ..... A47C 27/064 156/182
6,173,464 B1 1/2001 McCune et al.
6,175,997 B1 1/2001 Mossbeck
6,176,961 B1 1/2001 Mossbeck et al.
6,220,586 B1 4/2001 Pavlin et al.
6,256,820 B1 7/2001 Moser et al.
6,260,223 B1 7/2001 Mossbeck et al.
6,260,331 B1 7/2001 Stumpf
6,341,767 B1 1/2002 Seale et al.
6,397,418 B1 * 6/2002 Stjerna ..... A47C 27/062 5/655.8
6,398,199 B1 * 6/2002 Barber ..... F16F 3/04 267/93
6,408,514 B1 6/2002 Mossbeck et al.
6,574,811 B1 * 6/2003 Mossbeck ..... A47C 27/064 5/655.8
6,631,529 B1 10/2003 Erickson
6,684,435 B1 2/2004 Wells
6,684,608 B2 2/2004 Gibbons
6,688,457 B2 2/2004 Haubert et al.
6,718,726 B1 4/2004 Kuchel et al.
6,804,847 B2 10/2004 Grothaus
6,883,196 B2 4/2005 Barber
6,922,895 B1 8/2005 Whitworth
6,931,685 B2 * 8/2005 Kuchel ..... A47C 23/002 267/166.1
7,100,862 B2 9/2006 Skarzenski et al.
7,178,187 B2 * 2/2007 Barman ..... A47C 23/043 267/166.1
7,303,065 B2 12/2007 Kaufman et al.
7,644,461 B2 1/2010 Lee
7,827,637 B2 * 11/2010 DeFranks ..... A47C 27/005 5/483
7,850,153 B2 * 12/2010 Bock ..... A47C 23/002 267/103
7,877,964 B2 * 2/2011 Spinks ..... B68G 9/00 53/114
7,997,397 B2 8/2011 Akiyoshi
8,011,046 B2 * 9/2011 Stjerna ..... A47C 27/064 5/720
8,087,114 B2 * 1/2012 Lundevall ..... A47C 27/063 267/166
8,167,285 B2 5/2012 Balsells
8,266,745 B2 * 9/2012 Mossbeck ..... A47C 27/064 5/655.8
8,307,523 B2 * 11/2012 Mossbeck ..... A47C 27/053 29/91
8,382,653 B2 2/2013 Dubi et al.
9,670,053 B2 6/2017 Graf
9,943,173 B2 4/2018 Krtek et al.
10,633,245 B2 4/2020 Clare et al.
2002/0124321 A1 * 9/2002 Wells ..... A47C 27/063 5/720
2002/0124531 A1 9/2002 Mossbeck et al.
2003/0217413 A1 11/2003 Grothaus
2004/0025256 A1 2/2004 Mossbeck
2004/0070128 A1 4/2004 Balsells
2004/0103618 A1 6/2004 De Santis et al.
2004/0128773 A1 7/2004 Barber
2004/0172676 A1 9/2004 Franssen et al.
2004/0206051 A1 10/2004 Gecic et al.
2005/0007441 A1 1/2005 Hyuga
2005/0055778 A1 3/2005 Kuchel
2005/0224626 A1 10/2005 Pfeifer

(56) References Cited

U.S. PATENT DOCUMENTS

| | | | | |
|---|---|---|---|---|
| 2005/0257883 | A1 | 11/2005 | Anagnostopoulos | |
| 2006/0075567 | A1* | 4/2006 | DeFranks | A47C 27/005 5/699 |
| 2006/0236462 | A1* | 10/2006 | Boyd | A47C 31/001 5/698 |
| 2006/0272098 | A1 | 12/2006 | Hochschild | |
| 2006/0272928 | A1 | 12/2006 | Kritzinger | |
| 2007/0022538 | A1 | 2/2007 | Zschoch | |
| 2007/0022540 | A1 | 2/2007 | Hochschild | |
| 2007/0101507 | A1 | 5/2007 | Grothaus | |
| 2007/0124865 | A1 | 6/2007 | Stjerna | |
| 2007/0199155 | A1* | 8/2007 | Thygsen | A47C 27/005 5/737 |
| 2007/0216076 | A1 | 9/2007 | Ahn | |
| 2007/0235915 | A1 | 10/2007 | Ahn | |
| 2007/0256246 | A1* | 11/2007 | Gladney | A47C 31/001 5/737 |
| 2008/0054688 | A1* | 3/2008 | Longnecker | A47C 7/506 297/68 |
| 2008/0189824 | A1* | 8/2008 | Rock | D04B 1/02 2/69 |
| 2008/0246197 | A1 | 10/2008 | Mossbeck et al. | |
| 2009/0079113 | A1 | 3/2009 | Martin | |
| 2009/0266032 | A1* | 10/2009 | Spinks | B68G 9/00 53/438 |
| 2010/0212090 | A1 | 8/2010 | Stjerna | |
| 2010/0326012 | A1 | 12/2010 | Blunschi | |
| 2011/0209514 | A1 | 9/2011 | Huon | |
| 2012/0112396 | A1 | 5/2012 | DeFranks et al. | |
| 2012/0260422 | A1* | 10/2012 | Rock | A47G 9/0223 5/483 |
| 2013/0334747 | A1* | 12/2013 | Spinks | A47C 27/064 267/91 |
| 2014/0033440 | A1 | 2/2014 | Tyree | |
| 2014/0033441 | A1* | 2/2014 | Morgan | A47C 21/042 5/724 |
| 2015/0026893 | A1* | 1/2015 | Garrett | A47C 27/064 5/691 |
| 2015/0084251 | A1 | 3/2015 | Ahn | |
| 2016/0007761 | A1 | 1/2016 | Wolfson | |
| 2016/0249744 | A1 | 9/2016 | Eigenmann et al. | |
| 2016/0354820 | A1 | 12/2016 | Katou | |
| 2017/0008756 | A1 | 1/2017 | Clare et al. | |
| 2017/0340130 | A1 | 11/2017 | Mossbeck | |
| 2017/0354267 | A1 | 12/2017 | Alletto, Jr. | |
| 2019/0000239 | A1 | 1/2019 | Thomas et al. | |
| 2019/0290015 | A1 | 9/2019 | Fisher | |

FOREIGN PATENT DOCUMENTS

| | | | | |
|---|---|---|---|---|
| CN | 101140019 | A | 3/2008 | |
| CN | 201777876 | U | 3/2011 | |
| CN | 201890767 | U | 7/2011 | |
| CN | 202112703 | U | 1/2012 | |
| CN | 203740239 | U | 7/2014 | |
| DE | 899008 | C | 12/1953 | |
| DE | 3143269 | A1 | 5/1983 | |
| DE | 3514042 | A1 | 10/1986 | |
| DE | 4031651 | A1 | 4/1992 | |
| DE | 4031654 | A1 | 4/1992 | |
| DE | 4040220 | A1 | 6/1992 | |
| DE | 4225147 | A1 | 9/1993 | |
| DE | 4419206 | C1 | 3/1995 | |
| DE | 19529911 | A1 | 2/1997 | |
| DE | 10244766 | A1 | 5/2003 | |
| DE | 102008061465 | B3 | 8/2009 | |
| EP | 0089789 | A1 | 9/1983 | |
| EP | 252211 | A2 | 1/1988 | |
| EP | 0359035 | A1 | 3/1990 | |
| EP | 0401318 | A1 | 12/1990 | |
| EP | 0558078 | A1 | 9/1993 | |
| EP | 0899034 | A2 | 3/1999 | |
| EP | 0941962 | A1 | 9/1999 | |
| EP | 0943445 | A2 | 9/1999 | |
| EP | 1993947 | B1 | 3/2014 | |
| EP | 2565152 | B1 | 6/2014 | |
| ES | 2270477 | T3 | 4/2007 | |
| FR | 2171782 | A5 | 9/1973 | |
| FR | 2561620 | A1 | 9/1985 | |
| FR | 2606756 | A1 | 5/1988 | |
| FR | 2780624 | A1 | 1/2000 | |
| GB | 947298 | A | 1/1964 | |
| GB | 1461671 | A | 1/1977 | |
| GB | 2056336 | A | 3/1981 | |
| GB | 2437825 | A | 11/2007 | |
| GB | 2477139 | A | 7/2011 | |
| GB | 2488214 | A * | 8/2012 | A47C 27/064 |
| GB | 2537854 | A | 11/2016 | |
| GB | 2576216 | A | 2/2020 | |
| GB | 2523895 | B | 12/2020 | |
| JP | S5157452 | U | 5/1976 | |
| JP | 56090136 | A | 7/1981 | |
| JP | S60165121 | U | 11/1985 | |
| JP | S6134950 | U | 3/1986 | |
| JP | S6155867 | U | 4/1986 | |
| JP | 59212545 | A | 10/1989 | |
| JP | 2001340175 | A | 12/2001 | |
| KR | 101008136 | B1 | 6/2005 | |
| SU | 846007 | A1 | 7/1981 | |
| WO | 9203077 | A1 | 3/1992 | |
| WO | 9530622 | A1 | 11/1995 | |
| WO | 9617701 | A1 | 6/1996 | |
| WO | 9635637 | A1 | 11/1996 | |
| WO | 9947830 | A2 | 9/1999 | |
| WO | 9956591 | A1 | 11/1999 | |
| WO | 0126507 | A1 | 4/2001 | |
| WO | 0145875 | A1 | 6/2001 | |
| WO | 03027840 | A1 | 4/2003 | |
| WO | 03035304 | A1 | 5/2003 | |
| WO | 03036874 | A2 | 5/2003 | |
| WO | 2004099004 | A1 | 11/2004 | |
| WO | 2006043862 | A1 | 4/2006 | |
| WO | 2007031774 | A1 | 3/2007 | |
| WO | 2007102772 | A1 | 9/2007 | |
| WO | 2009030017 | A1 | 3/2009 | |
| WO | 2009111801 | A2 | 9/2009 | |
| WO | 2010026477 | A2 | 3/2010 | |
| WO | 2011142549 | A2 | 11/2011 | |
| WO | 2011142549 | A3 | 11/2011 | |
| WO | 2013054104 | A1 | 4/2013 | |
| WO | 2014113737 | A1 | 7/2014 | |
| WO | 2015087557 | A1 | 6/2015 | |
| WO | 2015114361 | A1 | 8/2015 | |
| WO | 2015114363 | A1 | 8/2015 | |
| WO | 2017137754 | A1 | 8/2017 | |
| WO | 2018220366 | A1 | 12/2018 | |
| WO | 2019034849 | A2 | 2/2019 | |
| WO | 2019034850 | A1 | 2/2019 | |

OTHER PUBLICATIONS

Search Report and Written Opinion issued by International Searching Authority in related International Patent App. No. PCT/GB2013/052131 dated Nov. 5, 2013 (8 pages).

International Preliminary Reporton Patentability issued by the International Bureau of WIPO in related International Application No. PCT/GB2013/052131 dated Feb. 10, 2015, 5 pages.

"Fold," Mirriam-Webster.com, Merriam-Webster, n.d. Wednesday, Jan. 29, 2018, 1 page.

International Search Report and Written Opinion issued by the International Searching Authority in related International Application No. PCT/GB2011/052169 dated Jan. 16, 2012, 6 pages.

International Preliminary Report on Patentability issued by the International Bureau of WIPO dated May 14, 2013 in related International Application No. PCT/GB2011/052169, 4 pages.

Non-Final Office Action issued by the U.S. Patent and Trademark Office dated Aug. 7, 2015 in related U.S. Appl. No. 13/884,049, 8 pages.

Final Office Action issued by the U.S. Patent and Trademark Office dated Apr. 27, 2016 in related U.S. Appl. No. 13/884,049, 9 pages.

(56) References Cited

OTHER PUBLICATIONS

Non-Final Office Action issued by the U.S. Patent and Trademark Office dated Nov. 10, 2016 in related U.S. Appl. No. 13/884,049, 6 pages.
Final Office Action issued by the U.S. Patent and Trademark Office dated May 4, 2017 in related U.S. Appl. No. 13/884,049, 8 pages.
Non-Final Office Action issued by the U.S. Patent and Trademark Office dated Jan. 30, 2018 in related U.S. Appl. No. 13/884,049, 5 pages.
Non-Final Office Action issued by the U.S. Patent and Trademark Office dated Oct. 1, 2015 in related U.S. Appl. No. 14/351,060, 8 pages.
Final Office Action issued by the U.S. Patent and Trademark Office dated Jul. 22, 2016 in related U.S. Appl. No. 14/351,060, 10 pages.
Final Office Action issued by the U.S. Patent and Trademark Office dated Jun. 8, 2017 in related U.S. Appl. No. 14/351,060, 11 pages.
Non-Final Office Action issued by the U.S. Patent and Trademark Office dated Mar. 21, 2018 in related U.S. Appl. No. 14/351,060, 13 pages.
Final Office Action issued by the U.S. Patent and Trademark Office dated Jan. 8, 2019 in related U.S. Appl. No. 14/351,060, 12 pages.
Non-Final Office Action issued by the U.S. Patent and Trademark Office dated Sep. 24, 2019 in related U.S. Appl. No. 14/351,060, 11 pages.
International Preliminary Report on Patentability issued by the International Bureau of WIPO dated Apr. 15, 2014 in related International Application No. PCT/GB2012/052503, 5 pages.
International Search Report and Written Opinion issued by the International Searching Authority dated Feb. 12, 2013 in related International Application No. PCT/GB2012/052503, 8 pages.
International Preliminary Report on Patentability issued by the International Bureau of WIPO dated Feb. 10, 2015 in related International Application No. PCT/GB2013/052129, 4 pages.
International Search Report and Written Opinion issued by the International Searching Authority dated Dec. 5, 2013 in related International Application No. PCT/GB2013/052129, 6 pages.
Non-Final Office Action issued by the U.S. Patent and Trademark Office dated Mar. 6, 2017 in related U.S. Appl. No. 14/420,692, 9 pages.
Final Office Action issued by the U.S. Patent and Trademark Office dated Sep. 20, 2017 in related U.S. Appl. No. 14/420,692, 8 pages.
Search Report issued by British Intellectual Property Office in related British Patent Application No. 1214305.3 dated Nov. 28, 2012, 3 pages.
International Preliminary Reporton Patentability issued by the International Bureau of WIPO in related International Application No. PCT/GB2013/052130 dated Feb. 10, 2015, 5 pages.
International Search Report and Written Opinion issued by the International Searching Authority in related International Application No. PCT/GB2013/052130 dated Nov. 27, 2013, 7 pages.
Non-Final Office Action issued by the U.S. Patent and Trademark Office in related U.S. Appl. No. 14/420,691 dated Jun. 23, 2015, 4 pages.
Search Report issued by British Intellectual Property Office in related British Patent Application No. 1214314.5 dated Nov. 9, 2012, 4 pages.
International Preliminary Report on Patentability issued by the International Bureau of WIPO in related International Application No. PCT/GB2015/050235 dated Aug. 2, 2016, 11 pages.
International Search Report and Written Opinion issued by the International Searching Authority in related International Application No. PCT/GB2015/050235 dated May 28, 2015, 14 pages.
Non-Final Office Action issued by the U.S. Patent and Trademark Office dated Sep. 11, 2018 in related U.S. Appl. No. 15/115,451, 10 pages.
Final Office Action issued by the U.S. Patent and Trademark Office dated Apr. 11, 2019 in related U.S. Appl. No. 15/115,451, 9 pages.
Non-Final Office Action issued by the U.S. Patent and Trademark Office dated Jan. 30, 2020 in related U.S. Appl. No. 15/115,451, 10 pages.
Search Report issued by British Intellectual Property Office in related British Patent Application No. 1401597.8 dated Oct. 8, 2014, 5 pages.
International Preliminary Report on Patentability issued by the International Bureau of WIPO in related International Application No. PCT/GB2015/050236 dated Aug. 2, 2016, 7 pages.
International Search Report and Written Opinion issued by the International Searching Authority in related International Application No. PCT/GB2015/050236 dated Apr. 20, 2015, 10 pages.
Non-Final Office Action issued by the U.S. Patent and Trademark Office dated Dec. 7, 2018 in related U.S. Appl. No. 15/115,460, 9 pages.
Final Office Action issued by the U.S. Patent and Trademark Office dated Jun. 4, 2019 in related U.S. Appl. No. 15/115,460, 11 pages.
Search Report issued by British Intellectual Property Office in related British Patent Application No. 1401606.7 dated Jul. 24, 2014, 3 pages.
International Preliminary Report on Patentability issued by the International Bureau of WIPO in related International Application No. PCT/GB2018/051465 dated Dec. 3, 2019, 14 pages.
International Search Report and Written Opinion issued by the International Searching Authority in related International Application No. PCT/GB2018/051465 dated Mar. 22, 2019, 20 pages.
International Preliminary Report on Patentability issued by the International Bureau of WIPO in related International Application No. PCT/GB2018/052278 dated Feb. 18, 2020, 9 pages.
International Search Report and Written Opinion issued by the International Searching Authority in related International Application No. PCT/GB2018/052278 dated Apr. 10, 2019, 11 pages.
International Preliminary Report on Patentability issued by the International Bureau of WIPO in related International Application No. PCT/GB2018/052279 dated Feb. 18, 2020, 5 pages.
International Search Report and Written Opinion issued by the International Searching Authority in related International Application No. PCT/GB2018/052279 dated Nov. 9, 2018, 7 pages.
Search Report issued by British Intellectual Property Office in related British Patent Application No. 1713098.0 dated Feb. 6, 2019, 2 pages.
Search Report issued by British Intellectual Property Office in related British Patent Application No. 1708639.8 dated Nov. 22, 2017, 5 pages.
Search Report issued by British Intellectual Property Office in related British Patent Application No. 1713096.4 dated Feb. 11, 2019, 2 pages.
Non-Final Office Action issued by the U.S. Patent and Trademark Office in related U.S. Appl. No. 16/637,340 dated Jul. 26, 2022, 13 pages.
Non-Final Office Action issued by the U.S. Patent and Trademark Office in related U.S. Appl. No. 16/637,302 dated May 27, 2021, 7 pages.
Final Office Action issued by the U.S. Patent and Trademark Office in related U.S. Appl. No. 15/115,451 dated Jun. 12, 2020, 14 pages.
International Search Report and Written Opinion issued by the International Searching Authority, the European Patent Office, for International Application No. PCT/GB2018/051469, dated Aug. 23, 2018, 9 pages.
International Preliminary Report on Patentability issued by the International Bureau of WIPO in related International Application No. PCT/GB2018/051469 dated Dec. 3, 2019, 7 pages.
Non-Final Office Action issued by the U.S. Patent and Trademark Office in related U.S. Appl. No. 16/616,081 dated Mar. 23, 2021, 12 pages.
Non-Final Office Action issued by the U.S. Patent and Trademark Office in related U.S. Appl. No. 16/615,993 dated Jun. 23, 2021, 11 pages.

* cited by examiner

RESILIENT UNIT WITH DIFFERENT MAJOR SURFACES

PRIORITY INFORMATION

The present invention claims priority to International Patent Application No. PCT/GB2013/052131 filed Aug. 8, 2013, that claims priority to GB Application No. 1214312.9, filed on Aug. 10, 2012, both of which are incorporated herein by reference in their entireties.

The present invention relates to a resilient unit, such as a pad, panel or mattress, which has different major surfaces.

The unit may be used in various applications, in particular where resilience is needed for comfort, convenience, support or protection.

Resilient pads are used in many applications to provide comfort, convenience, support and/or protection, for example to a person or object resting on, or wearing or using an article. Such pads are used, for example, in seats such as chairs or vehicle seats, in beds or tables, in mats such as exercise mats, in special packaging, and in clothing or shoes.

The ability to deform can provide comfort, for example in a seat, or can absorb energy from an impact, to provide protection, for example in a helmet or other article of clothing, or in packaging.

The present invention is defined in the attached independent claims to which reference should now be made. Further, preferred features may be found in the sub-claims appended thereto.

According to one aspect of the present invention there is provided a resilient unit suitable for providing comfort, convenience, support or protection, the unit comprising a pad having a plurality of resilient elements encapsulated in one or more pockets formed between first and second layers of material, wherein the first and second layers of material differ from one another.

Preferably the first and second layers of material differ from one another in respect of at least one characteristic from a group comprising optical, thermal, tactile, structural, chemical and physical.

Preferably the at least one characteristic comprises the presence, absence or degree of at least one property from a group including, waterproof, probiotic, antibacterial, antistatic, flavour, fragrance, flame-retardance, elasticity, wear resistance and permeability.

The first and second layers of material may differ from one another in thickness and/or weight. In a preferred arrangement the first and second layers may differ from one another in one or more defined zones on one or both layers, such that the layers may have substantially identical characteristics in parts and may differ in other parts and/or may differ by different characteristics in different parts.

At least one of the layers may comprise a composite layer made up of a plurality of sub-layers. The sub-layers may be bonded or otherwise joined together.

In a particularly preferred arrangement the resilient elements comprise springs located in pockets formed between the first and second layers. The springs may comprise coil springs and may be of wire. At least some of the springs may have coils of different diameters at opposed ends.

The first and second layers may be bonded, welded or otherwise joined together at spaced locations to form the pockets for the springs.

Preferably, in respect of at least some of the springs, the diameter of at least one of the coils is greater than the axial length of the spring in the pocket. For at least some of the springs the first and second layers may be joined together at a position that is closer to one end of the spring than the other.

The first and second layers may be welded together, for example ultrasonically or thermally. The weld may form a join that may be wider than it is tall, and is preferably substantially flat. In a preferred arrangement the pockets are formed from only the first and second layers.

For at least some springs the first and second layers of material may be joined at a position that is closer to an end of the spring having a coil of larger diameter.

Preferably substantially the same area of material is arranged to cover each end of the spring.

In a preferred arrangement the unit is also at least partly compressible in at least one direction transverse to the axis of the springs.

Preferably at least some of the springs are held under compression in their pockets.

The springs are preferably wire and are more preferably of steel, aluminium or titanium, or of an alloy thereof.

Preferably the unit is flexible in at least one lateral direction, generally perpendicular to the axis of the springs.

The unit may include a plurality of spring zones in which springs from different zones have at least one different characteristic. The characteristic may be the height of the spring. Alternatively or in addition the characteristic may be the stiffness or shape of the spring.

The unit may comprise more than one layer of pocketed springs.

In a preferred arrangement the unit includes at least one additional substrate layer above or below a layer of springs and/or between layers of springs. The additional substrate layer may comprise natural material and preferably comprises one or more of: leather, hemp, wool, silk, cotton, mohair, cashmere, feather, down, and alpaca.

The additional substrate layer may be arranged to provide, enhance or inhibit one or more characteristics, including but not limited to optical, thermal, tactile, structural, chemical and physical, and/or the presence, absence or degree of at least one property from a group including, waterproof, probiotic, antibacterial, antistatic, flavour, fragrance, flame-retardance, elasticity, wear resistance and permeability.

The invention also includes an article having at least one resilient unit according to any statement herein.

In accordance with the invention there is provided a seat comprising a resilient unit in the form of a pad according to any statement herein.

The seat may be a seat for use in relation to a vehicle, such as a wheeled vehicle, an aircraft, spacecraft or a ship or boat, or a saddle for an animal. The seat may comprise a chair, stool, bench, sofa or settee.

In accordance with another aspect there is provided a table comprising a resilient unit in the form of a pad according to any statement herein. The table may be an operating table or massage table, for example.

In accordance with a further aspect of the present invention there is provided an article of flooring comprising a resilient unit in the form of a pad according to any statement herein. The article of flooring may comprise a carpet, or carpet underlay, or a sport mat or exercise mat, or may be a leisure or sports surface either for indoor use or for outdoor use.

In accordance with a still further aspect of the invention there is provided a protective member, comprising a resilient unit according to any statement herein. The protective member may comprise an article of clothing or headgear, or may be a protective shield to be worn on the body of a user, or for attachment to an article.

According to a still further aspect of the invention there is provided an article of packaging, comprising a resilient unit in the form of a pad according to any statement herein.

According to a still further aspect of the invention there is provided a shoe or an insert for a shoe comprising a resilient unit in the form of a pad according to any statement herein.

The invention also provides a method of producing a resilient unit suitable for providing comfort, convenience, support or protection, the unit comprising a pad having a plurality of resilient elements encapsulated in one or more pockets formed between first and second layers of material, wherein the method comprises forming the pockets from the first and second layers of material by joining the layers together at least at locations between the resilient elements, and wherein the first and second layers are different from one another.

Preferably the first and second layers of material differ from one another in respect of at least one characteristic from a group including optical, thermal, tactile, structural, chemical and physical.

Preferably the at least one characteristic comprises the presence, absence or degree of at least one property from a group including, waterproof, probiotic, antibacterial, anti-static, flavour, fragrance, flame-retardance, elasticity, wear resistance and permeability.

The first and second layers of material may differ from one another in thickness and/or weight.

In a preferred arrangement the first and second layers may differ from one another in one or more defined zones on one or both layers, such that the layers may have substantially identical characteristics in parts and may differ in other parts and/or may differ by different characteristics in different parts.

Preferably the method comprises arranging a plurality of resilient elements, which may comprise coil springs in an array, each spring being substantially encased in an individual pocket.

Preferably, for at least some of the springs the layers are joined together at a position that is closer to one end of the spring than the other.

In one arrangement each spring comprises a number of coils. In respect of at least some springs the coils at opposed ends may be of different diameter.

The present invention may comprise any combination of the features or limitations referred to herein, except such a combination of features as are mutually exclusive.

Preferred embodiments of the present invention will now be described by way of example only with reference to the accompanying diagrammatic drawings in which.

Figure 1:
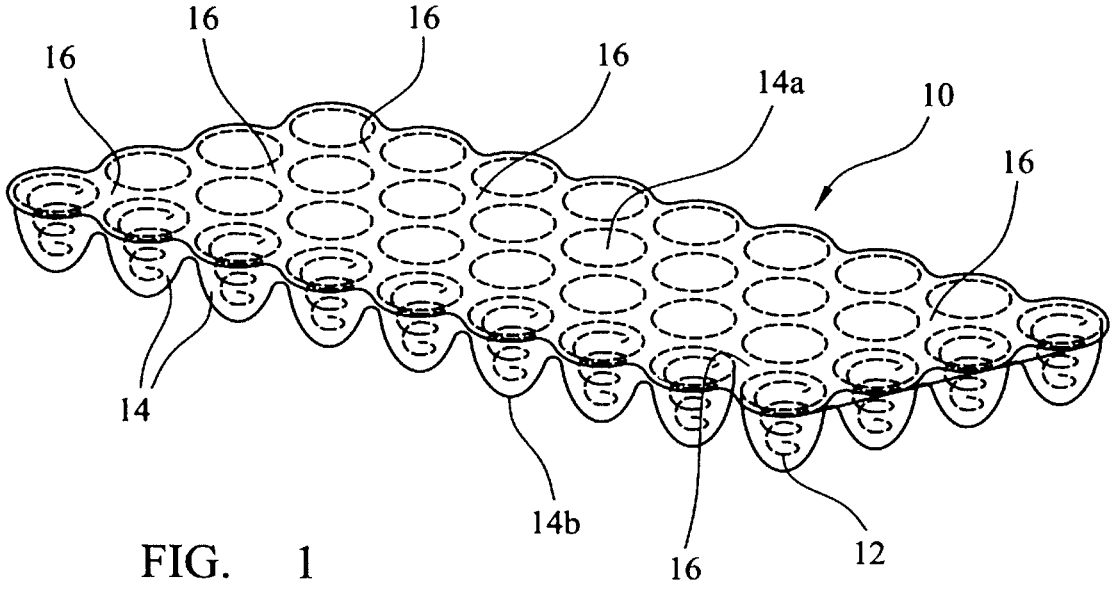
FIG. 1 shows, in schematic view, a portion of a resilient unit in the form of a pad, according to an embodiment of the present invention.

Resilient pads for various uses, in accordance with the embodiment of the present invention described below, comprise pocketed coil springs, which are sometimes referred to as encased springs. The pad typically comprises an array of metallic coil springs individually encased in pockets formed by bonding or otherwise joining together layers of material. A convenient process for manufacturing such a panel is described in our own co-pending European patent application number EP 1 993 947.

The springs are typically wider than they are tall, i.e. the diameter of at least one coil is greater than the height of the spring when in the pocket. However, in some embodiments, due to the coils at opposed ends being of different diameters and the position of the weld being closer to one end of the spring than the other, the individual springs are stable and can be at least as tall as the diameter of the largest coil, and possibly taller. The pad is stable, resilient and workable. Its plan shape can be cut to suit the desired shape of the article in which it is to be used, and because of its construction it is generally flexible, both in-plane and out-of plane.

The springs can be chosen for their stiffness and size, and can be grouped into zones and combined in such a way as to provide specifically desired performance characteristics. These characteristics can be determined by the intended use of the resilient pad.

An additional substrate layer may be placed on top of the pocketed springs, or below them, or in between adjacent layers of springs to improve comfort and/or performance of the pad. The additional layer preferably comprises natural materials such as hemp, cotton or wool, to assist in the recyclability of the pad.

In accordance with a particularly preferred embodiment at least some of the springs have coils of different diameters at opposed ends. Such springs have a number of advantages over springs in which the coils at each end of the spring are of substantially the same diameter. Firstly, the springs can be compressed to a substantially flat configuration, with the smaller diameter coils lying within the larger diameter coils. If the springs can be compressed entirely within themselves, such that no touching of adjacent coils takes place, this also provides a much quieter panel than is the case when the coils repeatedly abut one another.

Furthermore, the stiffness of a wire spring can be increased by reducing coil diameter, for a given gauge of wire. Therefore a narrower gauge spring can be made which uses less material to produce the same spring stiffness. It is necessary for the spring to have at least one coil of appropriate diameter to ensure stability within the pocket, and in particular to resist any tendency for the coil to invert within the pocket, but the other coils can be made narrower. Furthermore, a spring consisting of coils which reduce in diameter has a desirable characteristic, in that its stiffness increases progressively as it is compressed.

Another, preferred feature of the invention lies in the positions where the material layers are joined, in relation to the axial height of the spring. In previously considered pocketed springs the layers of material forming the pocket were welded or otherwise bonded together either at a position half way along the axial height of the spring, or else at one end of the spring. In accordance with preferred embodiments of the present invention the joining of the layers takes place at a position closer to one end of the spring, but not at the end. More preferably, the joining takes pace closer to the end of the spring having the coil of greater diameter. The quantity of material required to cover each end of the spring may be arranged to be substantially the same.

The inventors have found that this arrangement optimises stability of the spring within the pocket.

Furthermore, when the force compressing the spring acts on the end of the spring with the greater diameter coil, the pocket of one spring affects neighbouring springs more significantly, and also at an earlier point in the compression, as compared with the situation in which the join is at a halfway position, for example.

Turning to FIG. 1, there is shown, in schematic sectional view, generally at 10 a portion of a resilient pad according to an embodiment of the present invention. The pad comprises a number of wire coil springs 12, each of which is located within its own discrete pocket 14 formed by first, upper and second, lower layers 14*a* and 14*b* of material, preferably of non-woven material. The two layers 14*a* and 14*b* have been thermally, or ultrasonically, welded together at points 16 between the adjacent springs to create the pockets.

Figure 2:
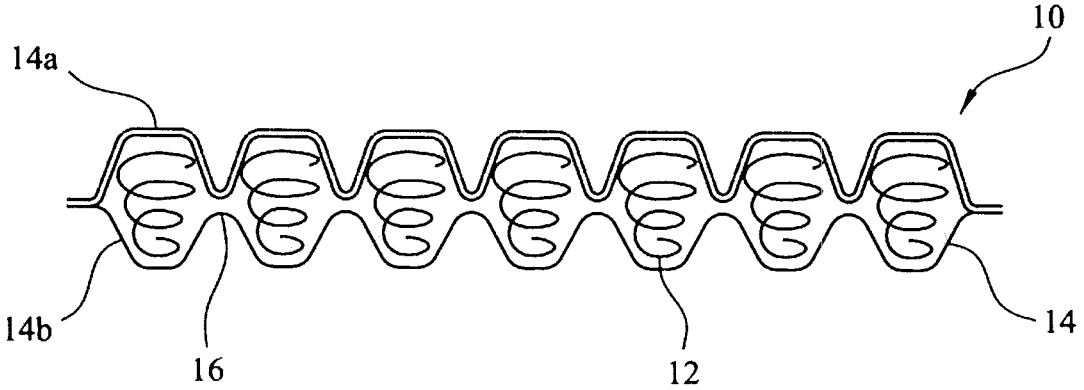
FIG. 2 shows in schematic sectional view a portion of the pad of FIG. 1.

FIG. 2 shows a portion of the pad in schematic cross-section. The upper layer of material 14*a* differs from the lower layer of material 14*b* in respect of at least one characteristic. In the example shown in the figures the upper layer is an air permeable layer, allowing air to freely circulate through the upper layer and into the spaces between the upper and lower layers. Meanwhile the lower layer 14*b* has a heat reflective coating on an inner, spring-facing side. This combination is well suited to a mattress or seat back, for example, in which the user's comfort is enhanced by heat retaining property of the lower reflective layer whilst air is allowed to circulate throughout the upper layer.

One or both of the layers may be a composite layer, made up of a plurality of sub-layers bonded or otherwise joined together. For example, the upper layer may be a composite layer that has air permeability and is also efficient at wicking, i.e. transferring moisture away from an outer surface.

The preferred method of manufacturing the pad is to bring together the upper and lower layers and to insert the partially compressed springs between the layers prior to welding or otherwise joining the upper and lower layers at edges and at positions between the springs. One example of such a method is described in our co-pending patent application referred to above.

The coil springs 12 have a generally frusto-conical shape, with, in each case, the uppermost coil 12*a* being of the greatest diameter, and the spring tapering to its lowermost coil 12*b* which is of the smallest diameter.

Whilst the springs shown in FIGS. 1 and 2 are of generally frusto-conical shape they could be of other shapes, such as cylindrical, hour glass or barrel shape.

The use of springs which have end coils of different diameters enables the unit to be thicker—ie the height of the springs to be greater—as compared with cylindrical springs using the same quantity of material, such as wire. The pad is also free from the noise which often accompanies an array of previously considered springs.

Figure 3:
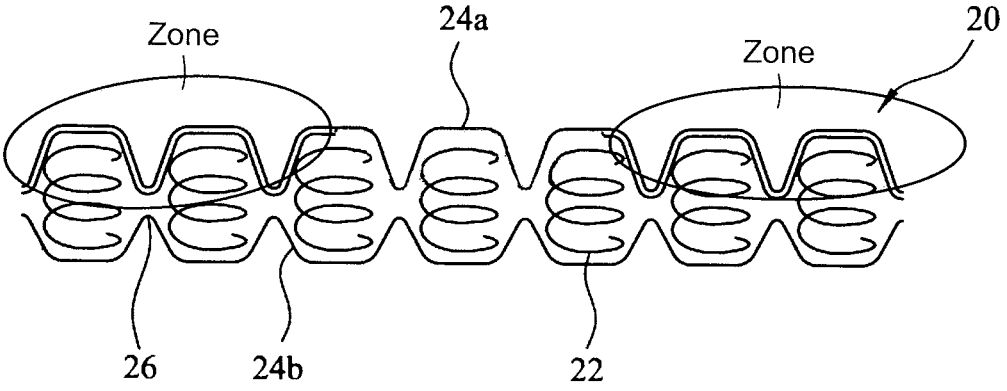
FIG. 3 shows in schematic sectional view a portion of a pad according to an alternative embodiment of the invention.

FIG. 3 shows another example of resilient unit 20 in which the first and second layers of material are different. Cylindrical springs 22 are encapsulated between an upper layer 24*a* of knitted open mesh having a high permeability and of a weight approximately 160 g/m2, and a lower layer 24*b* of spun-bonded, non-woven material of a weight approximately 50 g/m2. The open mesh of the upper layer allows air to permeate throughout the pad and is ideally suited as a user-facing side of the pad in applications such as seat bases, seat backs, mattresses and inner soles for shoes, for example.

The upper layer is also more elastic than the lower layer and this has the effect of pushing the weld point 26 past a mid-point towards the lower layer. This helps to improve the stability of the pad.

In what is perhaps its simplest form, the pad has first and second layers that are distinguished from one another in that one is perforated and the other is not, or one layer is perforated to a lesser degree than the other. This can result in a number of practical differences between the two layers including thermal, elastic, permeability and optical characteristics.

The above examples of resilient pad have a consistent type of pocketed spring throughout. However, the pad need not have pocketed springs that are all the same. The pad can have springs that are arranged in zones, with some areas having springs with one characteristic and others having different springs, for example so that the overall pad has areas with different resilience, where this is useful.

As mentioned above, seat bases and articles of flooring are only two of the possible uses of a resilient pad according to the present invention. Others include, but are not are not limited to: protective clothing or headgear, where a thin pad possibly of different zones of stiffness could be used, tables, beds and packaging.

The unit may typically be in the form of a pad or panel and may be used in various applications, in particular where resilience is needed for comfort, convenience, support or protection.

There are many possible combinations of first and second layers having different properties or characteristics. Examples include but are not limited to differences between the layers in respect of thermal characteristics, waterproofing, weight, density, water absorption or repellence, visual appearance, tactile properties, structural differences such as woven or non-woven, knitted, felted, resistance-to-wear characteristics, elasticity, antibacterial, anti-static, properties of flavour and/or fragrance and flame-retardance.

In another example (not shown), the resilient unit uses a reflective foil on or underneath an upper layer in a mattress or cushion in order to provide warmth for a user of the mattress or cushion. For example, a zone comprising reflective foil may be located at or towards a foot-end of a mattress to help to keep the user's feet warm. Similarly, zones of greater wear-resistance may be used where the unit faces greater use or greater friction and so would otherwise be more likely to wear.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A resilient unit suitable for providing comfort, convenience, support or protection, the unit comprising a pad having a plurality of individual coil springs of wire in an array, each spring having a spring axis and being substantially encased in an individual pocket formed between a first axially upper layer made of a first air permeable material and a second axially lower layer made of a second air permeable material, the first and second layers being joined at positions between the springs to form the pockets, wherein the first air permeable material and the second air permeable material are different materials, and wherein the first air permeable material of the first axially upper layer has a greater air permeability than the second air permeable material of the second axially lower layer such that air is allowed to circulate freely through the first axially upper layer and into spaces between the first axially upper layer and the second axially lower layer.

2. The unit according to claim 1, wherein the first and second layers of material further differ from one another in respect of at least one characteristic from a group comprising optical, thermal, tactile, structural, chemical and physical.

3. The unit according to claim 2, wherein the at least one characteristic comprises the presence, absence or degree of at least one property from a group including, waterproof, probiotic, antibacterial, antistatic, flavour, fragrance, flame-retardance, elasticity, wear resistance and permeability.

4. The unit according to claim 1, wherein the first and second layers of material further differ from one another in a thickness or a weight.

5. The unit according to claim 1, wherein the first and second layers further differ from one another in one or more defined zones on one or both layers, such that the layers have substantially identical characteristics in parts and differ in other parts.

6. The unit according to claim 1, wherein at least one of the layers comprises a composite layer made up of a plurality of sub-layers.

7. The unit according to claim 6, wherein the sub-layers are bonded or otherwise joined together.

8. The unit according to claim 1, wherein at least one of the springs have coils of different diameters at opposed ends.

9. The unit according to claim 1, wherein the first and second layers are any of bonded or welded together at spaced locations to form the pockets for the springs.

10. The unit according to claim 1, wherein, in respect of at least one of the springs, the diameter of at least one of the coils is greater than the axial length of the spring in the pocket.

11. The unit according to claim 1, wherein for at least one of the springs the first and second layers are joined together at a position that is closer to one end of the spring than the other.

12. The unit according to claim 1, wherein the first and second layers are welded together.

13. The unit according to claim 1, wherein the pockets are formed from only the first and second layers.

14. The article having at least one resilient unit according to claim 1.

15. A method of producing a resilient unit suitable for providing comfort, convenience, support or protection, the unit comprising a pad having a plurality of individual coil springs of wire in an array, each spring having a spring axis and being substantially encased in an individual pocket formed between a first axially upper layer made of a first air permeable material and a second axially lower layer made of a second air permeable material, wherein the method comprises joining the first layer and the second layer at least at locations between the springs to form a plurality of discrete pockets between the layers, wherein the first air permeable material and the second air permeable material are different materials, and wherein the first air permeable material of the first axially upper layer has a greater air permeability than the second air permeable material of the second axially lower layer such that air is allowed to circulate freely through the first axially upper layer and into spaces between the first axially upper layer and the second axially lower layer.

16. The method according to claim 15, wherein the first and second layers of material further differ from one another in respect of at least one characteristic from a group including optical, thermal, tactile, structural, chemical and physical.

17. The method according to claim 16, wherein the at least one characteristic comprises the presence, absence or degree of at least one property from a group including, waterproof, probiotic, antibacterial, antistatic, flavour, fragrance, flame-retardance, elasticity, wear resistance and permeability.

18. The method according to claim 15, wherein the first and second layers of material further differ from one another in a thickness or a weight.

19. The method according to claim 15, wherein the first and second layers further differ from one another in one or more defined zones on one or both layers, such that the layers have substantially identical characteristics in parts and differ in other parts.

20. The method according to claim 15, wherein the method comprises arranging a plurality of springs in an array.

21. The method according to claim 15, wherein, for at least one of the springs, the layers are joined together at a position that is closer to one end of the spring than the other.

22. The unit according to claim 1, wherein the first and second layers of material further differ from one another in that one of the layers is perforated and the other layer is not perforated or is perforated to a lesser degree.

23. The unit according to claim 1, wherein the first and second layers of material further differ from one another in their degree of elasticity.

24. The unit according to claim 1 wherein the second axially lower layer has a heat reflective coating.

25. The method according to claim 15, wherein one of the first layer and the second layer is perforated and the other of the first layer and the second layer is not perforated or is perforated to a lesser degree than the one of the first layer and the second layer to form the discrete pockets.

26. The method according to claim 15, wherein the first and second layers of material differ from one another in density.

27. The method according to claim 15, wherein the first and second layers further differ from one another in the presence, absence or degree of waterproofing to form the discrete pockets.

28. The method according to claim 15, wherein the first and second layers further differ from one another in their degree of elasticity to form the discrete pockets.

29. The method according to claim 15, wherein the second axially lower layer has a heat reflective coating.

30. The unit as recited in claim 1, wherein the first air permeable material of the first axially upper layer is a knitted open mesh and the second air permeable material of the second axially lower layer is a spun-bonded, non-woven material.

31. The method as recited in claim 15, wherein the first air permeable material of the first axially upper layer is a knitted open mesh and the second air permeable material of the second axially lower layer is a spun-bonded, non-woven material.

* * * * *